US012163753B2

(12) United States Patent
Stenzel

(10) Patent No.: US 12,163,753 B2
(45) Date of Patent: Dec. 10, 2024

(54) FIREARM WITH COMBINED BOLT CATCH AND EJECTOR

(71) Applicant: Stenzel Innovations Company, Maple Grove, MN (US)

(72) Inventor: Joseph I. Stenzel, Maple Grove, MN (US)

(73) Assignee: STENZEL INNOVATIONS COMPANY, Maple Grove, MN (US)

( * ) Notice: Subject to any disclaimer, the term of this patent is extended or adjusted under 35 U.S.C. 154(b) by 322 days.

(21) Appl. No.: 17/713,833

(22) Filed: Apr. 5, 2022

(65) Prior Publication Data

US 2022/0364810 A1 Nov. 17, 2022

Related U.S. Application Data

(63) Continuation-in-part of application No. 16/930,001, filed on Jul. 15, 2020, now Pat. No. 11,340,029.
(Continued)

(51) Int. Cl.

| | |
|---|---|
| ***F41A 3/66*** | (2006.01) |
| ***F41A 3/42*** | (2006.01) |
| ***F41A 3/68*** | (2006.01) |
| ***F41A 5/26*** | (2006.01) |
| ***F41A 15/14*** | (2006.01) |
| ***F41A 17/36*** | (2006.01) |
| ***F41A 35/06*** | (2006.01) |
| ***F41C 7/00*** | (2006.01) |
| ***F41C 23/14*** | (2006.01) |
| ***F41C 23/16*** | (2006.01) |

(52) U.S. Cl.
CPC ..... *F41A 3/66* (2013.01); *F41A 3/42* (2013.01); *F41A 3/68* (2013.01); *F41A 5/26* (2013.01); *F41A 15/14* (2013.01); *F41A 17/36* (2013.01); *F41A 35/06* (2013.01); *F41C 7/00* (2013.01); *F41C 23/14* (2013.01); *F41C 23/16* (2013.01)

(58) Field of Classification Search
None
See application file for complete search history.

(56) References Cited

U.S. PATENT DOCUMENTS 1,656,845 A * 1/1928 Sutter ..... F41A 9/59 89/138
2,618,878 A * 11/1952 Mulno ..... F41A 19/31 42/16

(Continued)

*Primary Examiner* — Reginald S Tillman, Jr.
(74) *Attorney, Agent, or Firm* — Bennet K. Langlotz; Langlotz Patent & Trademark Works, LLC

(57) ABSTRACT

Firearms with combined bolt catch and ejector have a bolt defining a bolt face configured to receive a case head of a cartridge, a bolt catch connected to a frame and movable between a first operational position in which bolt reciprocation forward from the rear position is enabled, and a second restraining position in which a portion of the bolt catch restrains the bolt in the rear position, and the bolt catch having an ejector surface portion positioned clear of the bolt face when the bolt catch is in the first operational position and in registration with a portion of the bolt face when the bolt catch is in the second restraining position such that a case head received by the bolt face strikes the ejector surface portion upon movement of the bolt from the forward to the rearward position when the bolt catch is in the second restraining position.

23 Claims, 12 Drawing Sheets

Related U.S. Application Data

(60) Provisional application No. 63/290,238, filed on Dec. 16, 2021, provisional application No. 63/172,817, filed on Apr. 9, 2021.

(56) References Cited

U.S. PATENT DOCUMENTS 3,269,044 A * 8/1966 Mittelsteadt ..... F41A 3/68 42/16
3,394,482 A * 7/1968 Badali ..... F41A 15/16 42/16
4,438,678 A * 3/1984 Ruger ..... F41A 15/16 89/138
5,608,981 A * 3/1997 Canaday ..... F41A 15/16 42/25
8,572,875 B2 * 11/2013 Sisgold ..... F41A 9/66 89/138

* cited by examiner

FIREARM WITH COMBINED BOLT CATCH AND EJECTOR

CROSS-REFERENCE TO RELATED APPLICATION

This application is a Continuation-in-Part of U.S. patent application Ser. No. 16/930,001 filed on Jul. 15, 2020, entitled "RIFLE WITH HYBRID RECEIVER, MODIFIED TRUNNION, GAS BLOCK AND AMBIDEXTROUS BOLT STOP," which is hereby incorporated by reference in its entirety for all that is taught and disclosed therein.

This application also claims the benefit of U.S. Provisional Patent Application No. 63/172,817 filed on Apr. 9, 2021, entitled "MODULAR AKM RIFLE HYBRID RECEIVER," which is hereby incorporated by reference in its entirety for all that is taught and disclosed therein.

This application also claims the benefit of U.S. Provisional Patent Application No. 63/290,238 filed on Dec. 16, 2021, entitled "MODULAR HYBRID FIREARM," which is hereby incorporated by reference in its entirety for all that is taught and disclosed therein.

FIELD OF THE INVENTION

The present invention relates to firearms, and more particularly to a firearm that combines the functions of the bolt catch and the ejector into a single component.

BACKGROUND AND SUMMARY OF THE INVENTION

The AKM rifle is an assault rifle that was the successor to the AK-47. The AKM rifle's design is more optimized for mass production relative to the AK-47. The AKM also incorporates improvements over the AK-47 including reduced weight, increased accuracy during fully automatic fire, and increased reliability. The AKM is extremely popular and remains in worldwide use despite having been designed in 1959.

One disadvantage of the AKM design is the lack of a bolt hold open capability after the last round of ammunition in the magazine has been fired and ejected.

Therefore, a need exists for a new and improved firearm with combined bolt catch and ejector that maintains the numerous benefits of the conventional AKM design while adding a bolt hold open capability. In this regard, the various embodiments of the present invention substantially fulfill at least some of these needs. In this respect, the firearm with combined bolt catch and ejector according to the present invention substantially departs from the conventional concepts and designs of the prior art, and in doing so provides an apparatus primarily developed for the purpose of maintaining the numerous benefits of the conventional AKM design while adding a bolt hold open capability.

The present invention provides an improved firearm with combined bolt catch and ejector, and overcomes the above-mentioned disadvantages and drawbacks of the prior art. As such, the general purpose of the present invention, which will be described subsequently in greater detail, is to provide an improved firearm with combined bolt catch and ejector that has all the advantages of the prior art mentioned above.

To attain this, the preferred embodiment of the present invention essentially comprises a frame, a barrel connected to the frame, the frame defining a magazine well configured to receive a magazine with a movable follower, the frame defining a bolt passage configured to receive a bolt, a bolt received in the bolt passage and operable to reciprocate between a rear position rearward of the magazine well and a forward position, the bolt defining a bolt face configured to receive a case head of a cartridge, a bolt catch connected to the frame and movable between a first operational position in which bolt reciprocation forward from the rear position is enabled, and a second restraining position in which a portion of the bolt catch restrains the bolt in the rear position, and the bolt catch having an ejector surface portion positioned clear of the bolt face when the bolt catch is in the first operational position and in registration with a portion of the bolt face when the bolt catch is in the second restraining position such that a case head received by the bolt face strikes the ejector surface portion upon movement of the bolt from the forward to rearward position when the bolt catch is in the second restraining position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
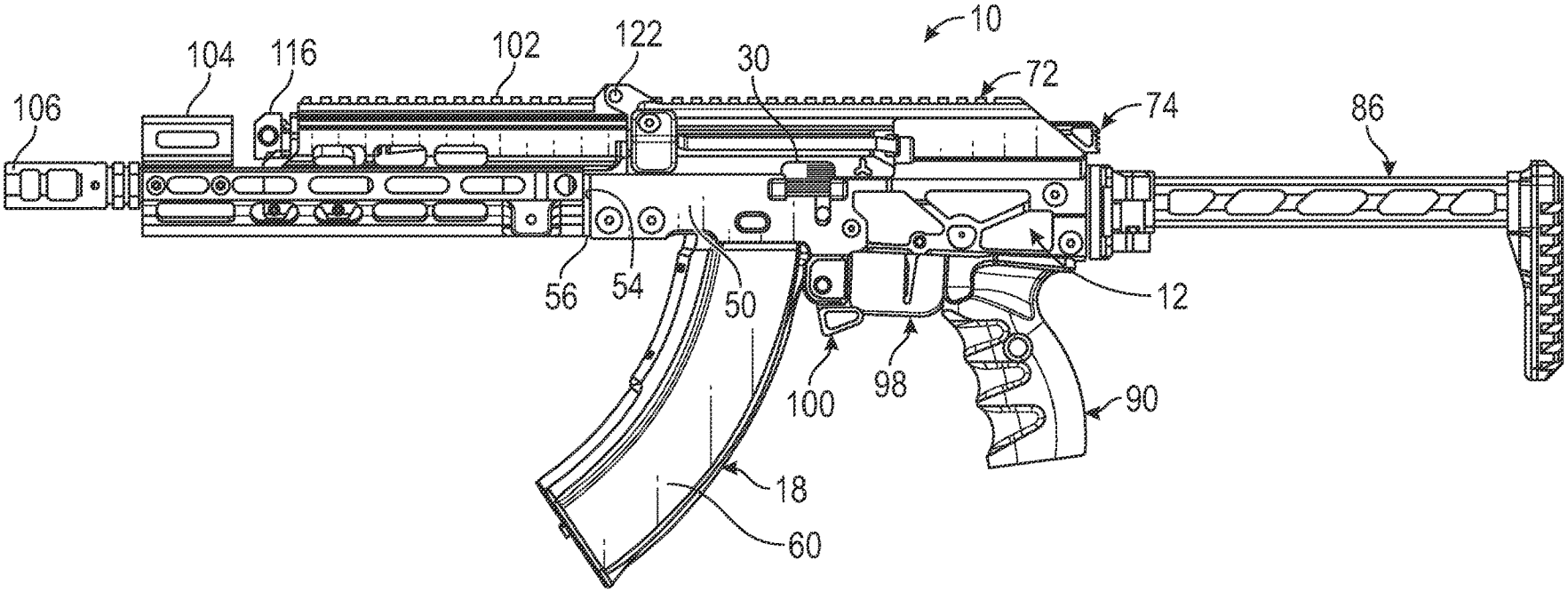
FIG. 1 is a side view of the current embodiment of a firearm with combined bolt catch and ejector constructed in accordance with the principles of the present invention.

An embodiment of the firearm with combined bolt catch and ejector of the present invention is shown and generally designated by the reference numeral 10.

Figure 2:
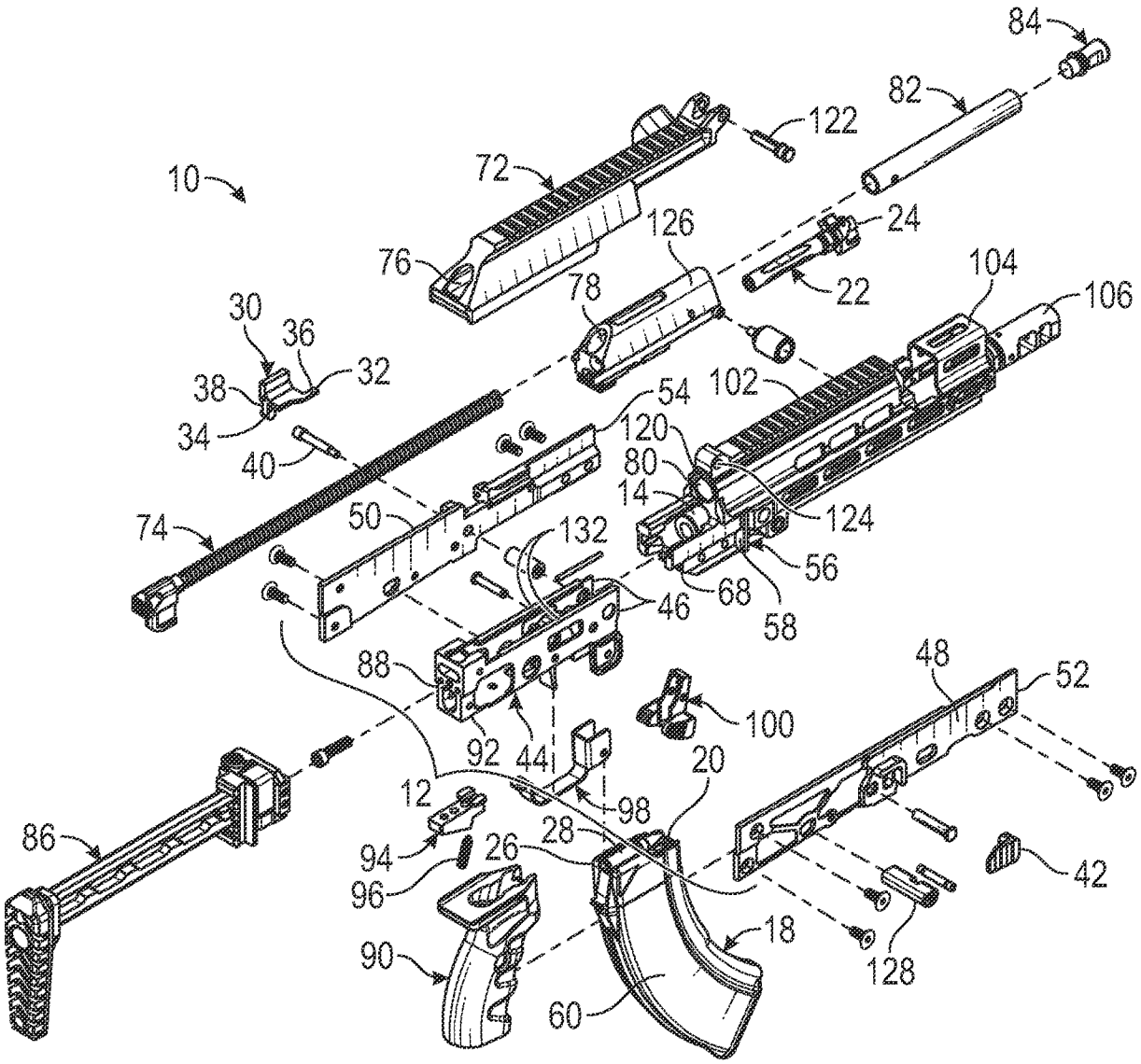
FIG. 2 is an exploded view of the firearm with combined bolt catch and ejector of FIG. 1.
Figure 3:
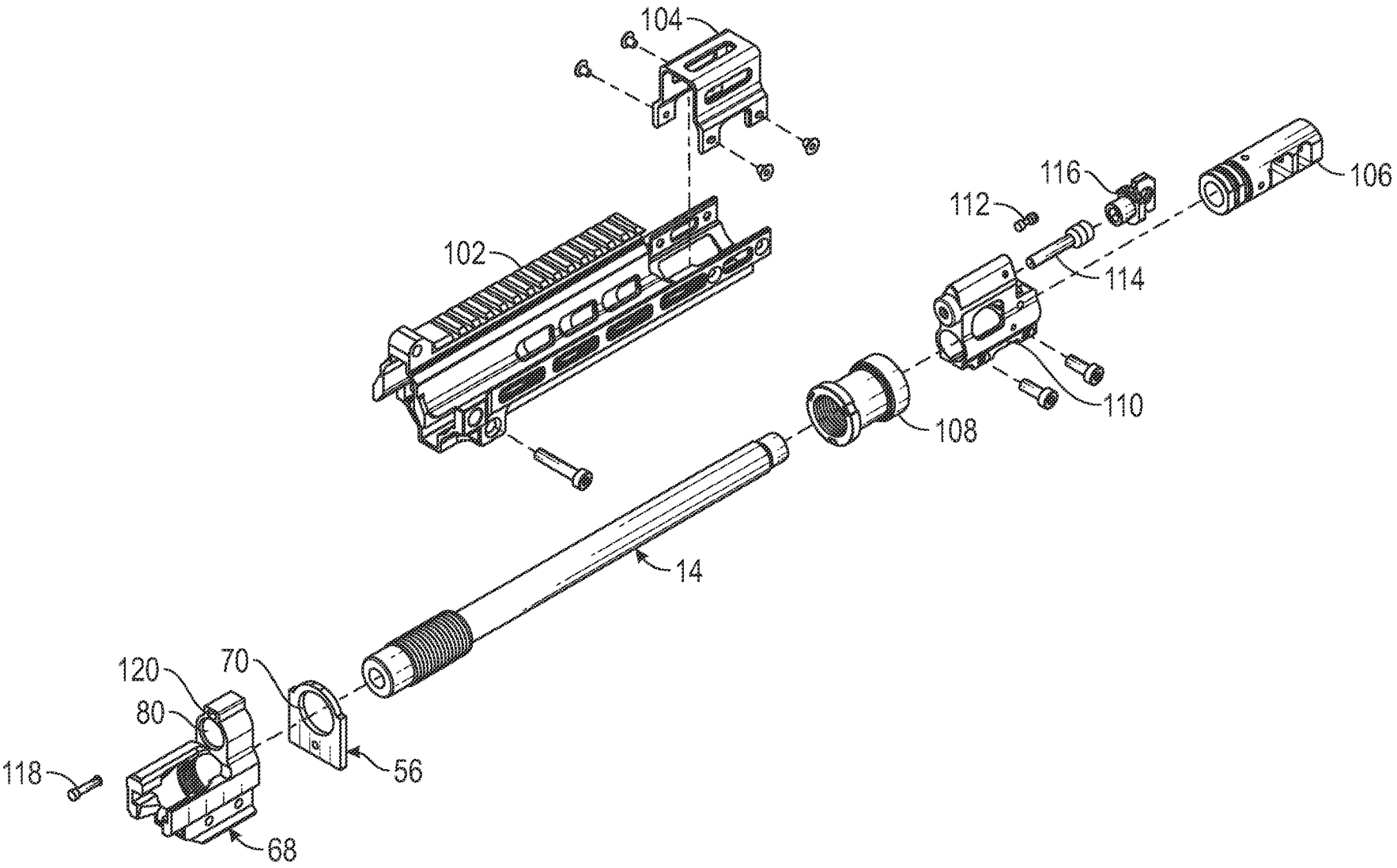
FIG. 3 is an exploded view of the barrel assembly of the firearm with combined bolt catch and ejector of FIG. 1.
Figure 4:
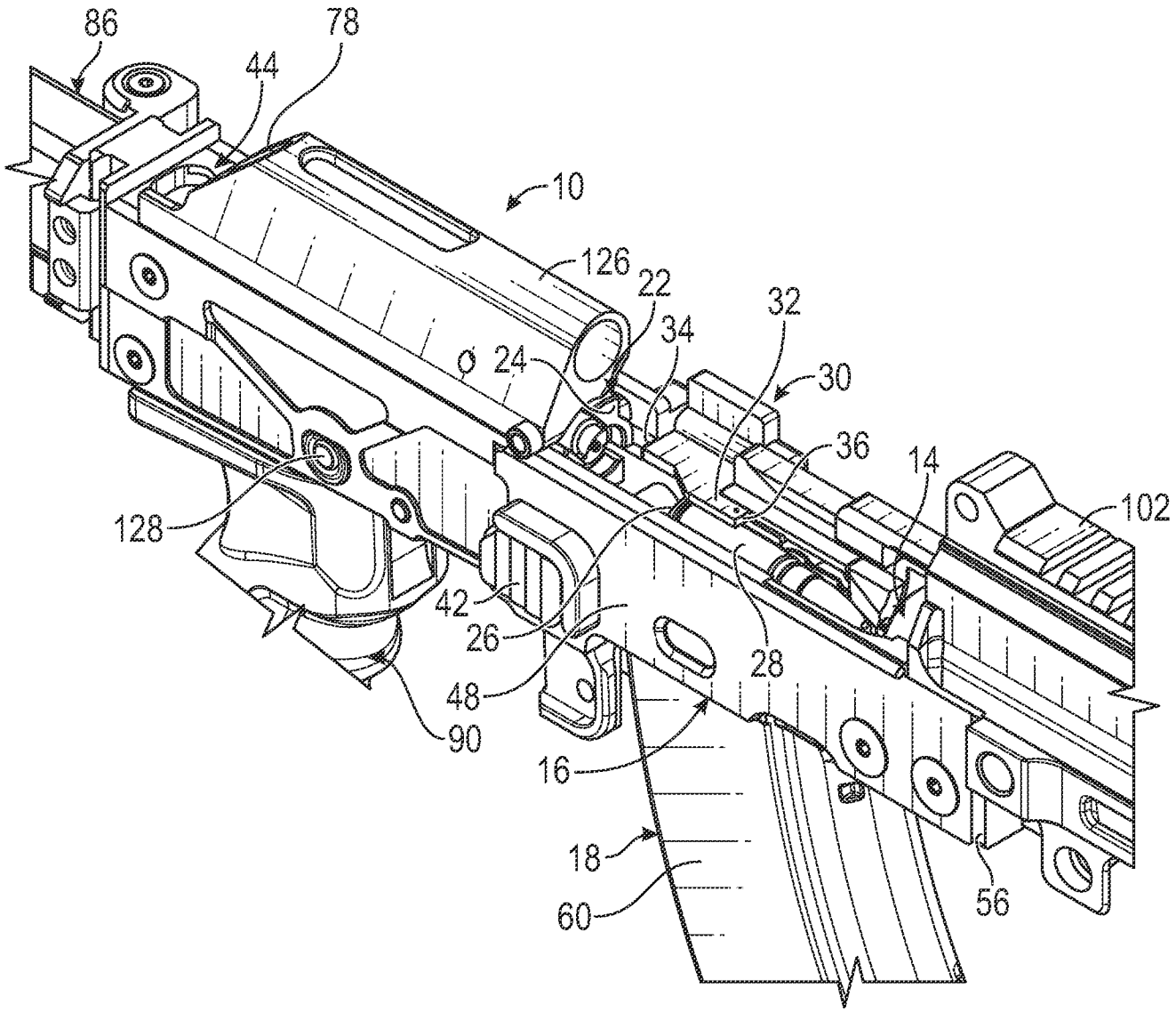
FIG. 4 is a top isometric enlarged view of the firearm with combined bolt catch and ejector of FIG. 1 with the combined bolt catch and ejector in the down position.
Figure 10:
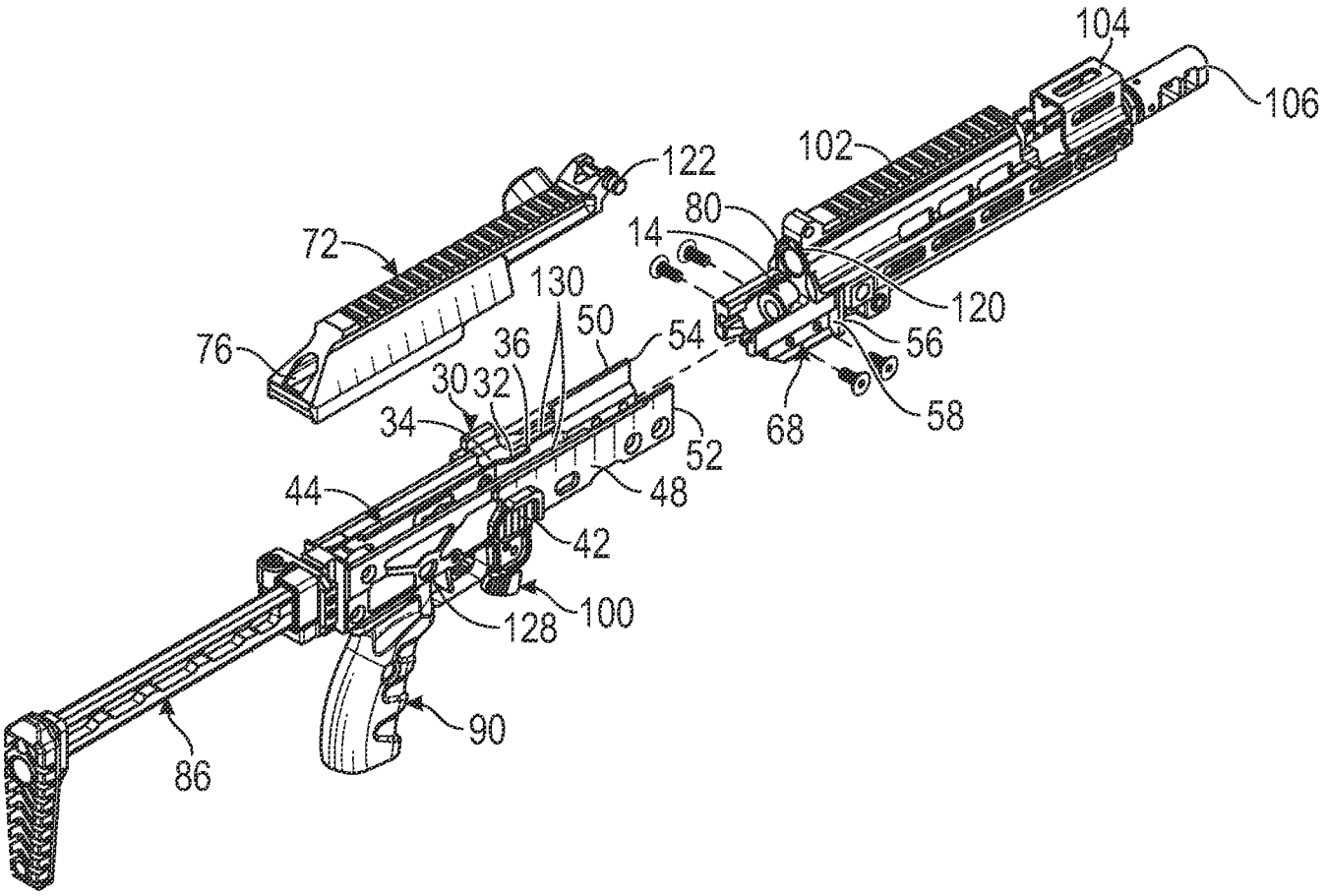
FIG. 10 is a partially exploded view of the firearm with combined bolt catch and ejector of FIG. 1.
Figure 11:
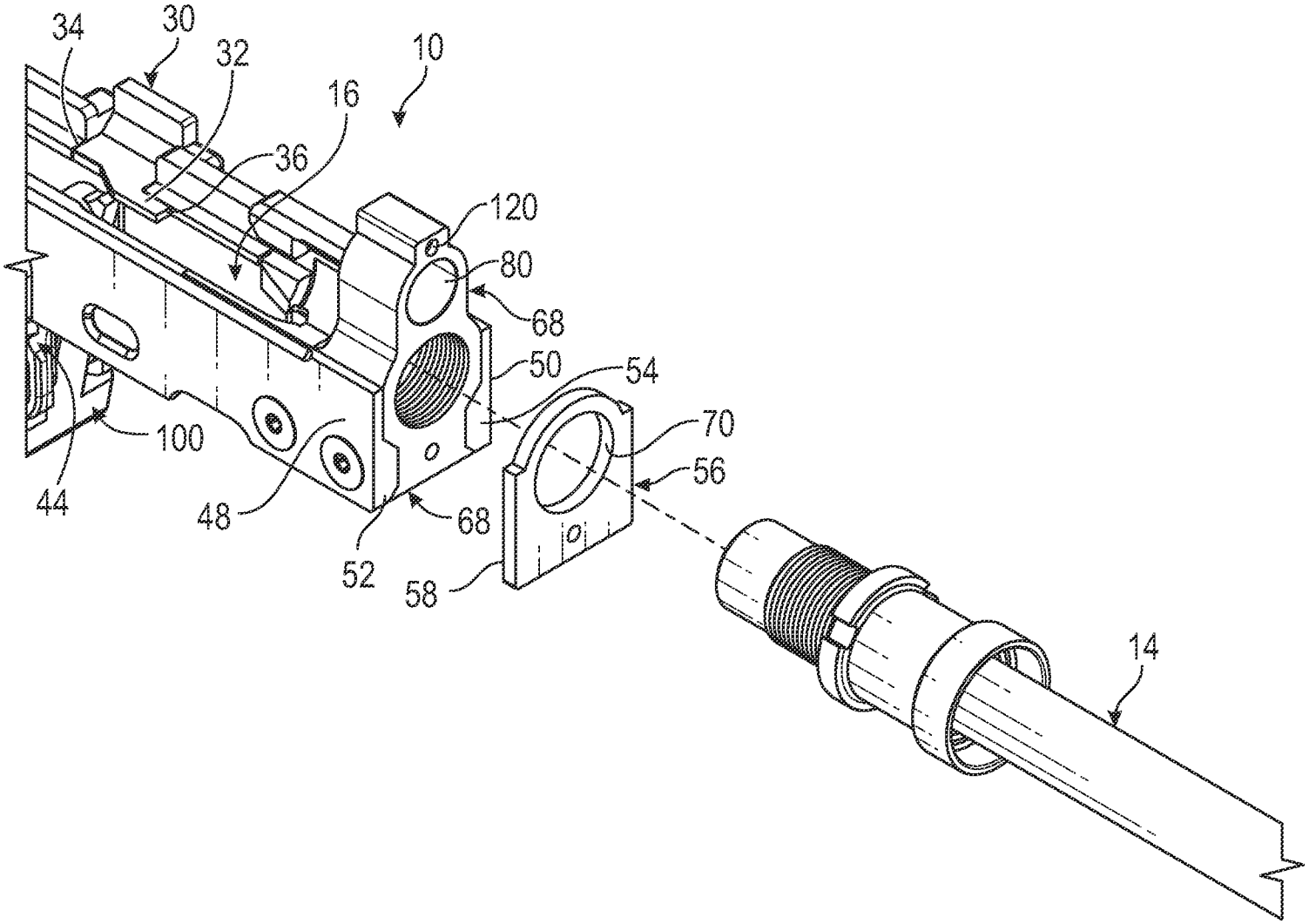
FIG. 11 is a partially exploded enlarged view of the firearm with combined bolt catch and ejector of FIG. 1.
Figure 12:
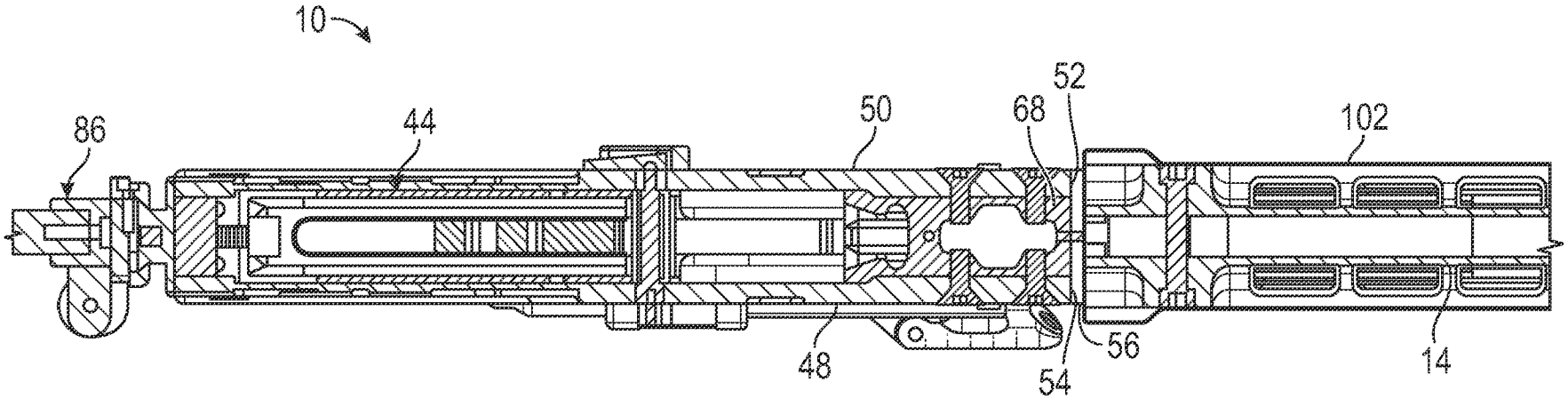
FIG. 12 is an enlarged sectional view of the firearm with combined bolt catch and ejector of FIG. 1.

FIGS. 1 & 2 illustrate the improved firearm with combined bolt catch and ejector 10 of the present invention. FIG. 3 illustrates the barrel assembly of the firearm with combined bolt catch and ejector 10 of the present invention. More particularly, the firearm with combined bolt catch and ejector has a frame 12 that consists of multiple elements that when assembled create various features and geometries. The frame elements are opposed side plates 48, 50, a barrel trunnion 68, and a fire-control housing 44. A barrel 14 is connected to the barrel trunnion portion of the frame. The frame defines a magazine well 16 (shown in FIG. 4) configured to receive a magazine 18 with a movable follower 20. The frame also defines a bolt passage 130 (shown in FIG. 10) defined by the opposed side plates and the rails 132 on the fire-control housing. The bolt passage is configured to receive a bolt 22. The bolt is received in the bolt passage and is operable to reciprocate between a rear position rearward of the magazine well and a forward position. The bolt defines a bolt face 24 configured to receive a case head 26 of a cartridge 28. A bolt catch 30 is connected to the frame and movable between a first operational position in which bolt reciprocation forward from the rear position is enabled, and a second restraining position in which a portion of the bolt catch restrains the bolt in the rear position. The bolt catch has an ejector surface portion 32 positioned clear of the bolt face when the bolt catch is in the second restraining position and in registration with a portion of the bolt face when the bolt catch is in the first operational position such that a case head received by the bolt face strikes the ejector surface portion upon movement of the bolt from the forward to the rearward position when the bolt catch is in the first operational position.

An optic mount 72 attached to the frame 12 above and behind the barrel 14. A recoil spring assembly 74 is received in a passage 76 defined by the optic mount, a passage 78 defined by the frame, and a passage 80 defined by the barrel trunnion 68. The recoil spring assembly interfaces with an operating rod 82 having an attached operating rod cap 84. Passage 80 serves as an operating rod guide hole. A butt stock 86 is attached to the rear 88 of the fire-control housing 44. A grip 90 is secured to the bottom 92 of the fire-control housing by a grip nut 94 and fastener 96. A trigger guard 98 is attached to the bottom of the fire-control housing in front of the grip. A magazine catch 100 is pivotally attached to the bottom of the fire-control housing forward of the trigger guard. The barrel is substantially enclosed by a tubular handguard 102. An accessory mount 104 is attached to the handguard. A muzzle device 106 is optionally attached to the barrel. The barrel is secured to the barrel trunnion by a barrel nut 108. The barrel nut enables the tubular handguard to be attached. A gas block 110 has a gas regulator detent 112, piston 114, and gas regulator 116. The gas block components enable gas escaping from the barrel to provide energy for the piston to act on the operating rod to compress the recoil spring assembly and cycle the bolt 22.

An optic mount plunger 118 is housed by the barrel trunnion 68 in a passage 120. The optic mount 72 includes a protruding tab (not visible) that acts against the optic mount plunger to create tension on the optic mount when the optic mount is in the closed position. The resulting tension aids in optic zero retention by reducing movement of the optic mount. The optic mount hinges on a pin 122 received in a passage 124 defined by the handguard 102 so the optic mount can pivot between the closed position and an open position to enable removal of the bolt 22 and the bolt carrier assembly portion of the frame 12 (the breach block 126, operating rod 82, and operating rod cap 84). The optic mount plunger holds the optic mount open when the optic mount is in the open position. The operating rod cap 84 is conical in shape, which allows the bolt carrier assembly to pivot up and out of the passage 80 in the barrel trunnion 68 when the optic mount pivots to the open position. The invention also includes a cross bolt fire selector 128, which is ambidextrous.

Dividing the bolt carrier assembly into three components (the breach block 126, operating rod 82, and operating rod cap 84) allows for easier and less costly fabrication and also creates the ability to use different materials and heat treatments for each component. The operating rod and operating rod cap can be fabricated from hard steel, while the breach block can be fabricated from a lighter material, such as titanium. Compared to a prior art AKM rifle breach block, the breach block of the current invention has a greater length. The greater length eliminates the need for a dust cover fire selector because the additional length covers the charging handle slot on the optic mount 72. The additional length also allows for the addition of rails and slots that, when the breach block is in the forwardmost position, rest behind the magazine well 16. Prior art AKM rifles require two separate rails on each side of the receiver, one for supporting the bolt carrier assembly, and one for supporting the bolt. The current invention enables the use of a single rail on each side of the firearm with combined bolt catch and ejector 10 to support both the bolt carrier assembly and the bolt 22, which is simpler and more efficient. This approach also enables the fire-control housing 44 to be manufactured as a separate component.

The barrel trunnion 68 is a considerably modified version of the AKM rifle's barrel trunnion. The barrel trunnion of the current invention adds angled surfaces and threaded mounting holes that interface with the opposing side plates 48, 50. The added passage 80 enables the operating rod 82 to slide through the barrel trunnion while the bolt carrier assembly reciprocates during firearm operation. The passage 120 for the optic mount plunger 118 is also an added feature. The passage 80 enables use of a modern short strike gas system which increases the firearm's accuracy by eliminating the gas tube, which otherwise interferes with natural barrel harmonics. The barrel trunnion also enables the frame 12 to made from aluminum instead of stamped sheet metal used for prior art AKM rifles for lighter weight, ease of manufacture, and corrosion resistance.

The fire-control housing 44 houses the firing mechanism, incorporates the magazine catch housing and magazine guide ears, features two guide rails that the breach block 126 and bolt 22 travel along, and incorporates a rear trunnion and a recoil spring lug. The rear trunnion acts as a spacer for the opposing side plates 48, 50. The butt stock 86 attaches to the rear trunnion portion. The fire-control housing also acts as a spacer and attachment point for the opposed side plates 48, 50, which results in the magazine well 16 being located well forward of the forward surface 46 of the fire-control housing. The fire-control housing can be manufactured as a unitary component that includes all of the listed features, or can be a multi-component assembly where the rear trunnion, guide rails, firing mechanism housing, magazine catch housing, and magazine guide ears are separate components.

As is shown in FIGS. 2 & 4-9, the bolt catch 30 has a rear-facing catch surface 34 configured to catch the bolt 22 and a forward-facing ejector surface 36. The bolt catch is a unitary body in the current embodiment. The bolt catch has an actuator element 38 external to the frame 12 and configured to move the bolt catch by external contact. A transverse actuator 40 is operably connected to the bolt catch and has an actuator 42 external to the frame on an opposite side from the actuator element. The forward-facing ejector surface moves with the bolt catch and moves relative to the frame.

Figure 5:
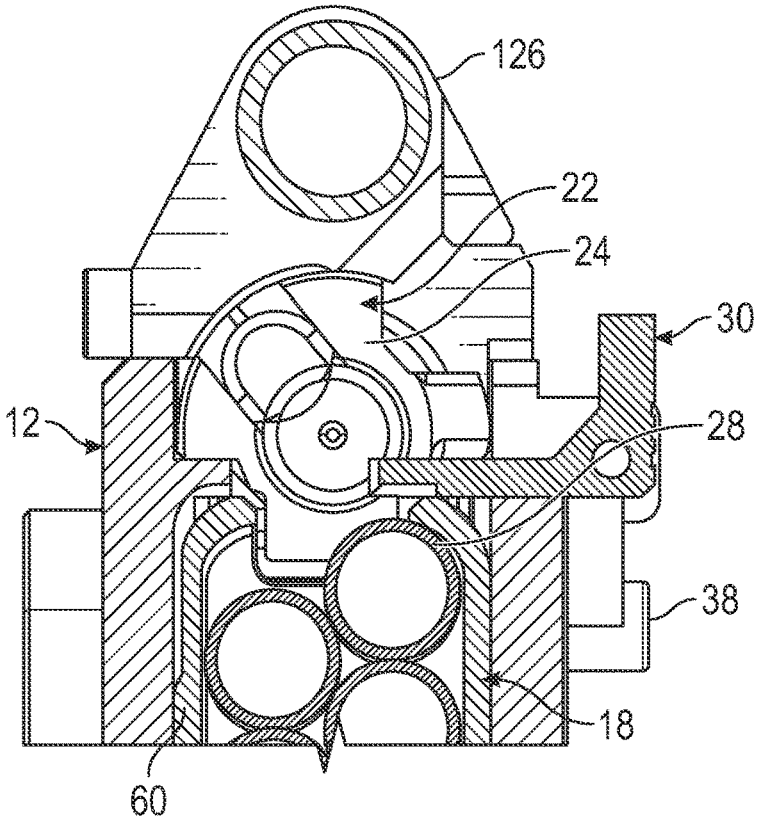
FIG. 5 is a front sectional view of the firearm with combined bolt catch and ejector of FIG. 1 showing the combined bolt catch and ejector in the down position.
Figure 6:
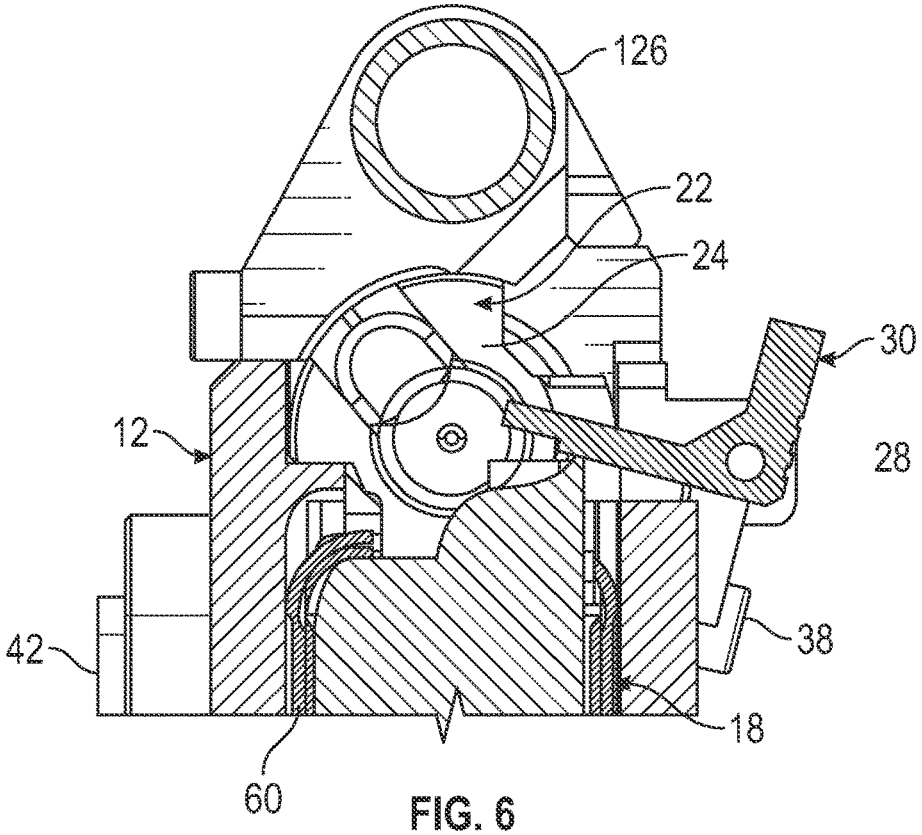
FIG. 6 is a front sectional view of the firearm with combined bolt catch and ejector taken along line 5-5 of FIG. 1 showing the combined bolt catch and ejector in the raised position.
Figure 7:
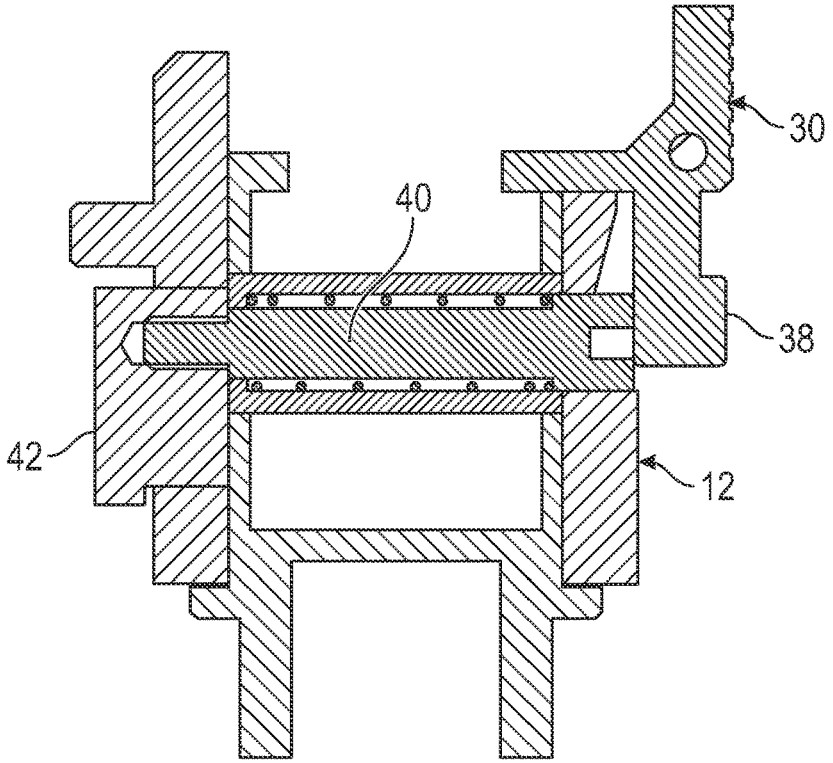
FIG. 7 is a front sectional view of the firearm with combined bolt catch and ejector taken along line 7-7 of FIG. 1 showing the combined bolt catch and ejector in the down position.
Figure 8:
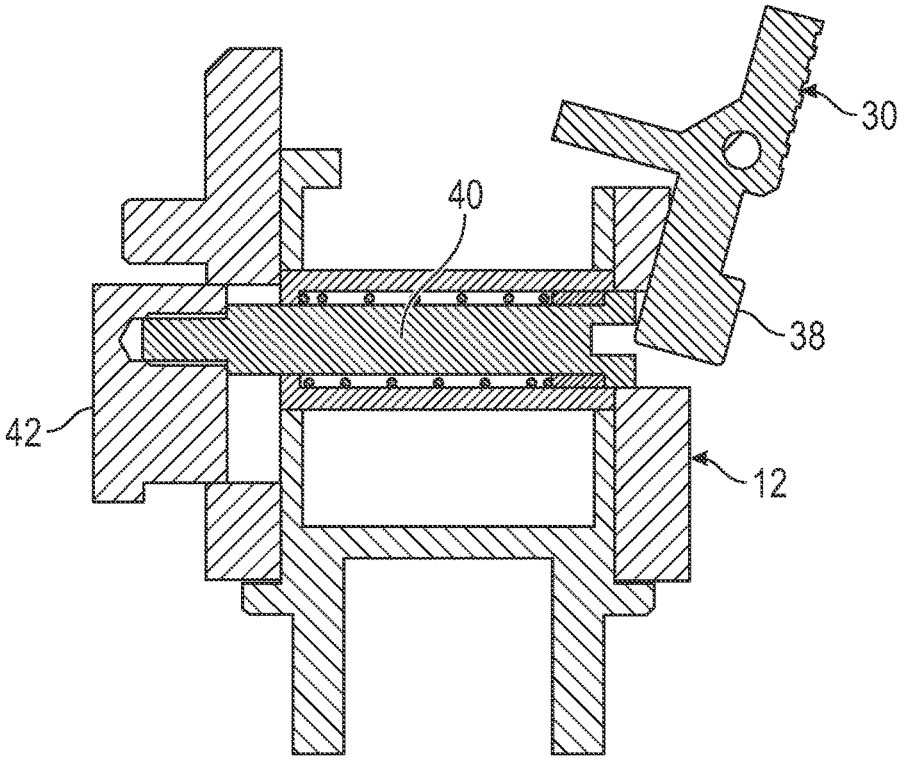
FIG. 8 is a front sectional view of the firearm with combined bolt catch and ejector taken along line 7-7 of FIG. 1 showing the combined bolt catch and ejector in the raised position.
Figure 9:
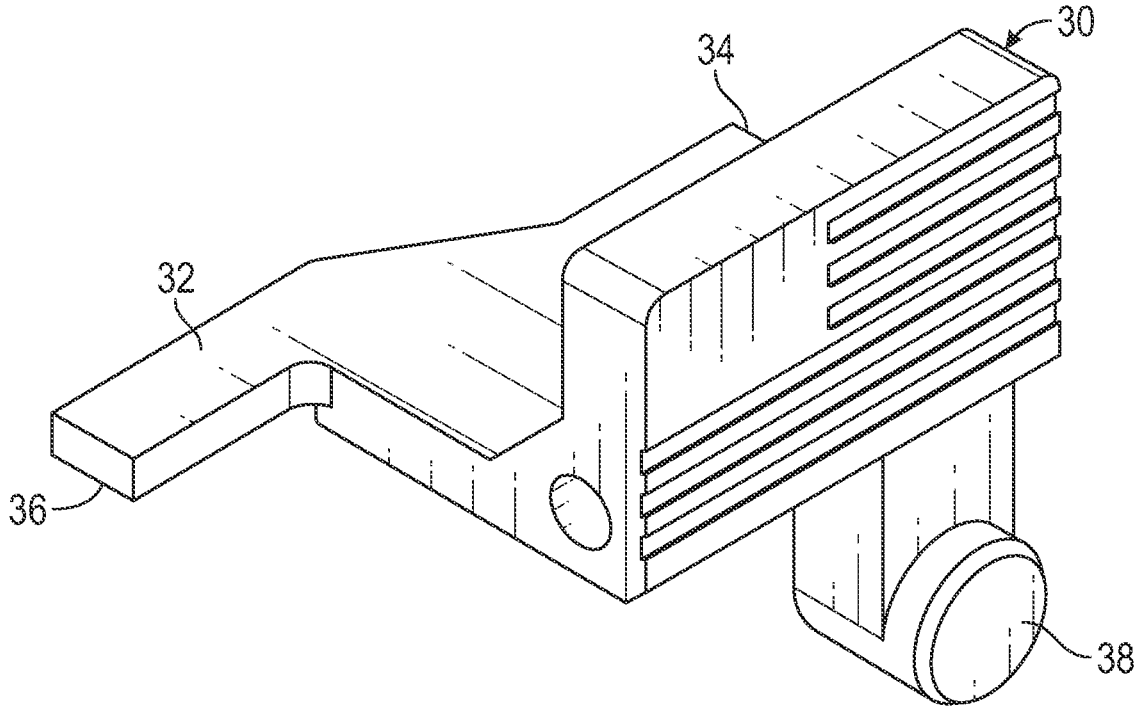
FIG. 9 is a top isometric view of the combined bolt catch and ejector of the present invention.

FIG. 5 shows the bolt catch 30 in the down position when ammunition is present in the magazine 18. FIG. 6 shows the bolt catch being actuated upward by the protrusion 66 on the follower 20. FIG. 7 shows a section view of the bolt catch mechanism where the transverse actuator 40 is attached to the actuator 42 and pushes on the bolt catch, forcing the bolt catch into the down position. FIG. 8 shows a section view of the bolt catch mechanism where the transverse actuator is attached to the actuator. When the protrusion on the follower pushes up on the bolt catch, the transverse actuator is engaged, compressing a spring, and causing the actuator to protrude opposite the bolt catch. The addition of the transverse actuator and actuator enable faster reloading. The operator can remove the empty magazine 18, insert a loaded magazine, and press either the actuator element 38 on the bolt catch or the actuator to release the bolt 22 and chamber a round of ammunition.

As is shown in FIGS. 2 & 10-12, the frame 12 includes the fire-control housing 44 having a forward surface 46 between opposed side plates 48, 50, each having a forward edge 52, 54, and the barrel trunnion 68. A recoil lug 56 abuts the barrel 14 and has a rear surface 58 abutting the forward edges of the opposed side plates. It should be appreciated that the fire-control housing does not contact the barrel trunnion or the recoil lug. The recoil lug also has an aperture 70 that receives the barrel and is compressed against the barrel trunnion 68 by the barrel nut 108. The overlap of the recoil lug with the forward edges of the opposed side plates ensures recoil forces are not transferred through fasteners to the opposed side plates and mitigates recoil stress experienced by the frame because of the larger contact surface area created by the recoil lug.

Figures 13A, 13B, 13C:
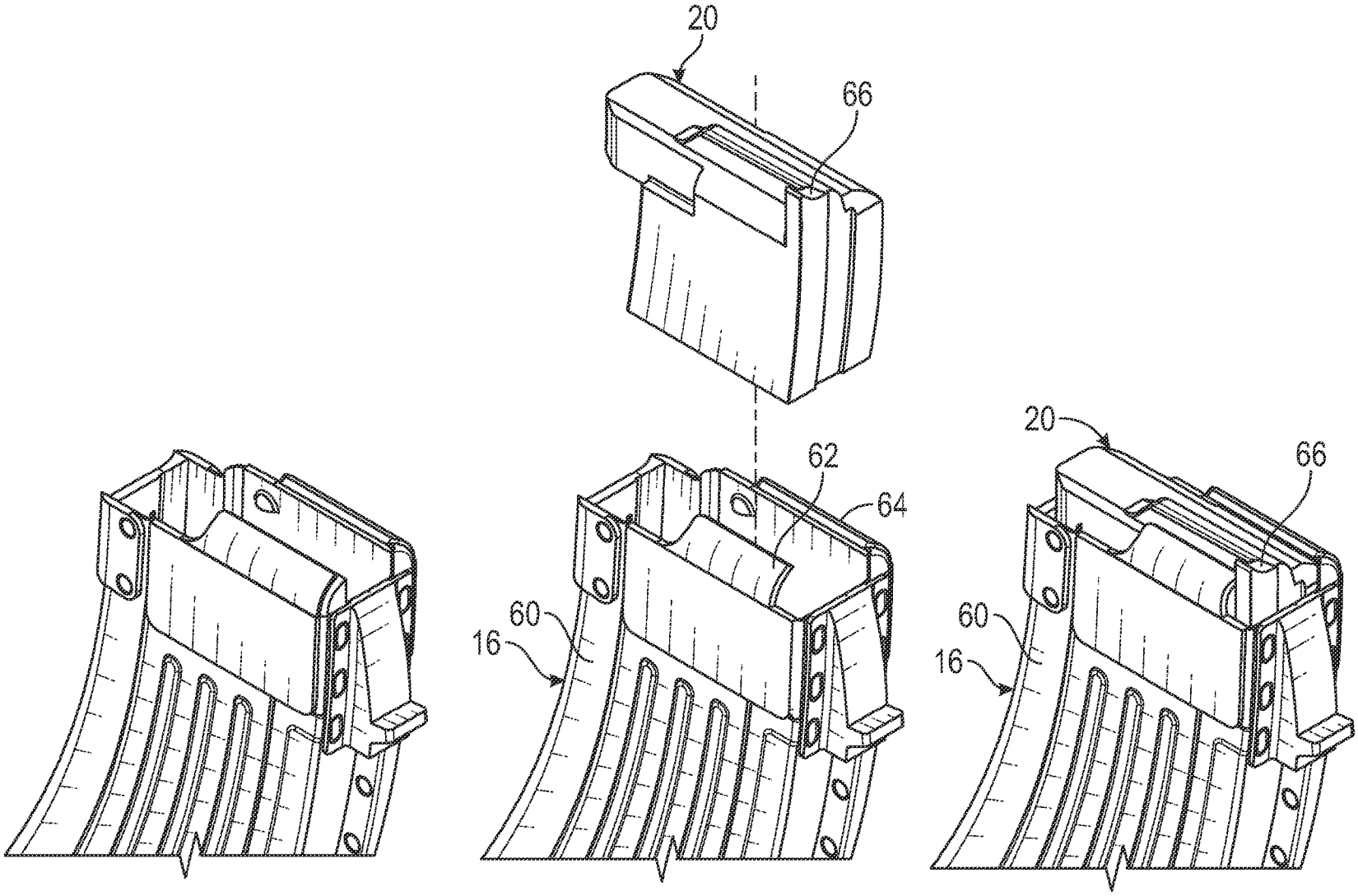
FIG. 13A (Prior Art)
FIG. 13A is an enlarged top isometric fragmentary view of a prior art AKM rifle magazine.
FIG. 13B is an enlarged fragmentary exploded view of the magazine and follower of FIG. 5.
FIG. 13C is an enlarged fragmentary view of the magazine and follower of FIG. 5.

As is shown in FIGS. 13A-C, with FIG. 13A showing a prior art AKM rifle magazine and FIGS. 13B & C showing the magazine 18 of the current invention, the magazine 18 has a body 60 with upper feed lips 62, 64. The movable follower 20 has a protrusion 66 extending above the upper feed lips when the movable follower is in an uppermost position. A portion of upper feed lip 62 has been removed relative to the prior art AKM rifle magazine shown in FIG. 13A so as to not obstruct the follower's protrusion. The protrusion is configured to motivate the bolt catch 30 to the second restraining position when the movable follower is in the uppermost position. When the magazine is in the magazine well 16, the rear-facing catch surface is above the upper feed lips when in the restraining position.

When ammunition is present in the magazine 18, the bolt catch 30 remains in the down position and acts as an ejector because the ejector surface portion 32 is aligned with the case head 26. The bolt 22 is free to reciprocate normally with the bolt catch in the down position. Once the last round of ammunition in the magazine has been chambered, fired, extracted, and ejected, the follower 20 moves upward and the protrusion 66 actuates the bolt catch to an upward position, where the rear-facing catch surface 34 blocks the bolt from moving forward.

Figure 14:
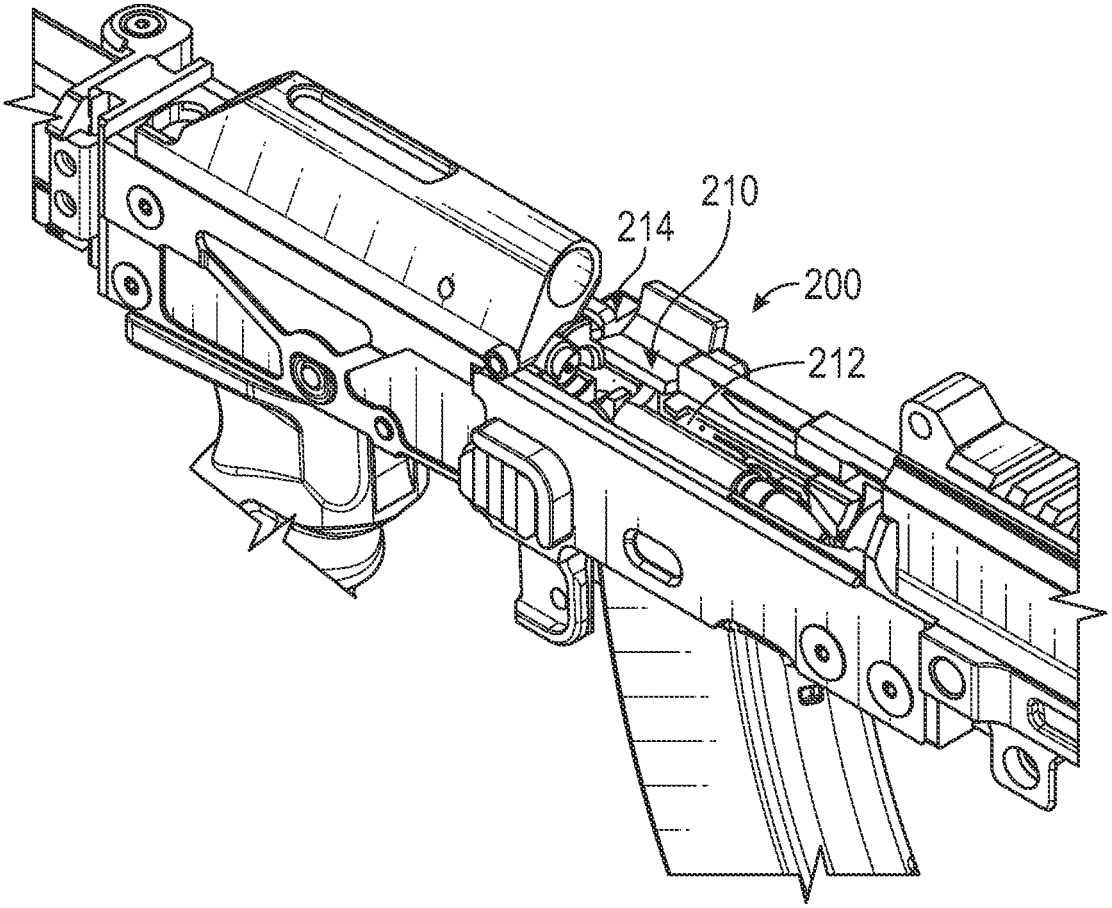
FIG. 14 is a top isometric enlarged view of an alternative embodiment of a firearm with the bolt catch and ejector separated into two components.

FIG. 14 illustrates an alternative embodiment of the improved firearm with combined bolt catch and ejector 200 of the present invention. More particularly, the bolt catch 210 and ejector 212 are formed as two separate components, with the ejector attached to the frame 214.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm with combined bolt catch and ejector has been described in detail, it should be apparent that modifications and variations thereto are possible, all of which fall within the true spirit and scope of the invention. Although a single barrel caliber and length has been disclosed, the firearm with combined bolt catch and ejector is a multi-caliber/multi-length free float barrel system that can be used with a traditional AKM rifle long stroke gas system or a modern short stroke gas block system. Furthermore, although the bolt catch disclosed includes a forward-facing ejector surface, ejector surface portion, rear-facing catch surface, and actuator element, one or more of these features could be removed for attachment of the bolt catch to a traditional AKM rifle. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame;

a barrel connected to the frame;

the frame defining a magazine well configured to receive a magazine with a movable follower;

the frame defining a bolt passage configured to receive a bolt;

a bolt received in the bolt passage and operable to reciprocate between a rear position rearward of the magazine well and a forward position;

the bolt defining a bolt face configured to receive a case head of a cartridge;

a bolt catch connected to the frame and movable between a first operational position in which bolt reciprocation forward from the rear position is enabled, and a second restraining position in which a portion of the bolt catch restrains the bolt in the rear position;

the bolt catch having an ejector surface portion positioned clear of the bolt face when the bolt catch is in the second restraining position and in registration with a portion of the bolt face when the bolt catch is in the first operational position such that a case head received by the bolt face strikes the ejector surface portion upon movement of the bolt from the forward to the rearward position when the bolt catch is in the first operational position;

the bolt catch having a first actuator surface operable in response to force by a user to move the bolt catch from the first operational position to the second restraining position; and the bolt catch having a second actuator surface operable in response to force by a user to move the bolt catch from the second restraining position to the first operational position.

2. The firearm of claim 1 wherein the bolt catch has a rear-facing catch surface configured to catch the bolt and a forward-facing ejector surface.

3. The firearm of claim 1 wherein the bolt catch is a unitary body.

4. The firearm of claim 1 wherein the bolt catch has an actuator element external to the frame and configured to move the bolt catch by external contact.

5. A firearm comprising:

a frame;

a barrel connected to the frame;

the frame defining a magazine well configured to receive a magazine with a movable follower;

the frame defining a bolt passage configured to receive a bolt;

a bolt received in the bolt passage and operable to reciprocate between a rear position rearward of the magazine well and a forward position;

the bolt defining a bolt face configured to receive a case head of a cartridge;

a bolt catch connected to the frame and movable between a first operational position in which bolt reciprocation forward from the rear position is enabled, and a second restraining position in which a portion of the bolt catch restrains the bolt in the rear position;

the bolt catch having an ejector surface portion positioned clear of the bolt face when the bolt catch is in the second restraining position and in registration with a portion of the bolt face when the bolt catch is in the first operational position such that a case head received by the bolt face strikes the ejector surface portion upon movement of the bolt from the forward to the rearward position when the bolt catch is in the first operational position;

wherein the bolt catch has an actuator element external to the frame and configured to move the bolt cat by external contact; and including a transverse actuator operably connected to the bolt catch and having an actuator external to the frame on an opposite side from the actuator element.

6. The firearm of claim 1 wherein the forward-facing ejector surface moves with the bolt catch.

7. The firearm of claim 1 wherein the forward-facing ejector surface moves relative to the frame.

8. The firearm of claim 1 wherein the frame includes a fire-control housing having a forward surface between opposed side plates each having a forward edge, and a recoil lug abutting the barrel and having a rear surface abutting the forward edges of the opposed side plates.

9. The firearm of claim 1 including a magazine having a body with upper feed lips, and wherein the movable follower has a protrusion extending above the upper feed lips when the movable follower is in an uppermost position, the protrusion configured to motivate the bolt catch to the second restraining position when the movable follower is in the uppermost position.

10. A firearm comprising:

a frame;

a barrel connected to the frame;

the frame defining a magazine well configured to receive a magazine with a movable follower;

the frame defining a bolt passage configured to receive a bolt;

a bolt received in the bolt passage and operable to reciprocate between a rear position rearward of the magazine well and a forward position;

the bolt defining a bolt face configured to receive a case head of a cartridge;

a bolt catch connected to the frame and movable between a first operational position in which bolt reciprocation forward from the rear position is enabled, and a second restraining position in which a portion of the bolt catch restrains the bolt in the rear position;

a magazine having a body with upper feed lips the follower having a protrusion extending above the upper feed lips when the follower is in an uppermost position;

the protrusion configured to motivate the bolt catch to the second restraining position when the follower is in the uppermost position;

the bolt catch having a first actuator surface operable in response to force by a user to move the bolt catch from the first operational position to the second restraining position; and the bolt catch having a second actuator surface operable in response to force by a user to move the bolt catch from the second restraining position to the first operational position.

11. The firearm of claim 10 wherein the bolt catch has a rear-facing catch surface configured to catch the bolt and forward-facing ejector surface.

12. The firearm of claim 11 wherein when the magazine is in the magazine well, the rear-facing catch surface is above the upper feed lips when in the restraining position.

13. The firearm of claim 10 wherein the bolt catch is a unitary body.

14. The firearm of claim 10 wherein the bolt catch has an actuator element external to the frame and configured to move the bolt catch by external contact.

15. A firearm comprising:

a frame;

a barrel connected to the frame;

the frame defining a magazine well configured to receive a magazine with a movable follower;

the frame defining a bolt passage configured to receive a bolt;

a bolt received in the bolt passage and operable to reciprocate between a rear position rearward of magazine well and a forward position;

the bolt defining a bolt face configured to receive a case head of a cartridge;

a bolt catch connected to the frame and movable between a first operational position in which bolt reciprocation forward from the rear position is enabled, and a second restraining position in which a portion of the bolt catch restraints the bolt in the rear position;

a magazine having a body with upper feed lips the follower having a protrusion extending above the upper feed lips when the follower is in an uppermost position;

the protrusion configured to motivate the bolt catch to the second restraining position when the follower is in the uppermost position;

wherein the bold catch has an actuator element external to the frame and configured to move the bold catch by external contact; and including a transverse actuator operably connected to the bolt catch and having an actuator external to the frame on an opposite side from the actuator element.

16. The firearm of claim 10 wherein the forward-facing ejector surface moves with the bolt catch.

17. The firearm of claim 10 wherein the forward-facing ejector surface moves relative to the frame.

18. The firearm of claim 10 wherein the frame includes a fire-control housing having a forward surface between opposed side plates each having a forward edge, and a recoil lug abutting the barrel and having a rear surface abutting the forward edges of the side plates.

19. The firearm of claim 1 including the first and second actuator surfaces being positioned at a lateral side panel of the frame.

20. The firearm of claim 1 including the first and second actuator surfaces being positioned vertically one above the other.

21. The firearm of claim 1 including the first and second actuator surfaces being on a single unitary body.

22. The firearm of claim 1 including the bolt catch being pivotally connected to the frame to pivot about a pivot axis.

23. The firearm of claim 22 including the pivot axis being positioned between the first and second actuator surfaces.

* * * * *